US006250544B1

(12) United States Patent
Chen

(10) Patent No.: US 6,250,544 B1
(45) Date of Patent: Jun. 26, 2001

(54) PAPERBOARD BOX

(76) Inventor: Shiu-Lin Chen, 13F, No. 100, Sec. 1, Wen Hua II Rd., Lin Kou Hsiang, Taipei Hsien (TW)

( * ) Notice: Subject to any disclaimer, the term of this patent is extended or adjusted under 35 U.S.C. 154(b) by 0 days.

(21) Appl. No.: 09/588,719

(22) Filed: Jun. 7, 2000

(30) Foreign Application Priority Data

Jul. 5, 1999 (TW) ..... 088211181

(51) Int. Cl.[7] ..... B65D 5/44; A45C 13/36

(52) U.S. Cl. ..... 229/198; 190/122; 190/127; 229/199

(58) Field of Search ..... 229/198, 198.3, 229/199; 190/122, 124, 127

(56) References Cited

U.S. PATENT DOCUMENTS

| | | | | |
|---|---|---|---|---|
| 2,554,021 | * | 5/1951 | Goldman | 229/198 |
| 3,214,077 | * | 10/1965 | Schwartz | 229/199 |
| 4,669,587 | * | 6/1987 | Zitt | 190/124 |
| 5,156,328 | * | 10/1992 | Wozniacki | 229/198 |
| 5,823,424 | * | 10/1998 | Allen | 229/198 |

* cited by examiner

*Primary Examiner*—Gary E. Elkins
(74) *Attorney, Agent, or Firm*—Bacon & Thomas, PLLC

(57) ABSTRACT

A paperboard box with improved structure comprising a one-piece paperboard, an in-box frame, several washers and screws. On the one-piece paper board there are 2 horizontal and 4 vertical creases, which partition the board into a top section and a base section with each having right side, left side, front side and back side. The back side is where the top and the base connect with each other. On both the top and the base sections, extended panels are disposed at the two ends of the left side and the right side. Each panel has a pre-pierced hole on the center. When the paperboard is folded into a box shape, the panels are folded inwards, and other pierced holes that correspond to the holes of the panels are also mounted on the front side, right side and left side. Several curved washers with holes thereon are then arranged on the corners of the base and the top, where the front side meets the left side and the right side. The holes on the washers are corresponding to the holes on the panels and the holes on two ends of the front sides. Screws including bolts and nuts are used to secure the paperboard box through the holes. Finally, an in-box frame is fitted into the base of the box.

1 Claim, 4 Drawing Sheets

PAPERBOARD BOX

BACKGROUND OF THE INVENTION

1. Field of the Invention

This invention relates generally to a paperboard box with improved structure and, more specifically, to a paperboard box having pre-pierced holes through which the box is screwed and fastened, and thus the box can be easily assembled by users.

2. Description of the Prior Art

Heretofore, it is known to construct a paperboard box with two separate pieces of paperboard, with one board folded into the base and the other as the top lid. On each of these two paperboards, there are 2 vertical and 2 horizontal creases partitioning the paperboard into a top, a base and 4 sides(i.e., right, left, front and back). At the ends of the right, left, and front sides there are extended panels which, when the board is folded, are to be folded inwards and would stick together to secure the cube. The top lid and the base of the box are then put together with their open ends facing each other and are adhered to each other at one side of the open ends. An in-box frame is fitted into the base so that the box can tightly close.

The construction of such boxes typically requires specific glue to be applied to secure the cubes. The special equipment and techniques required for applying the glue would cause difficulties for users who wish to set up the boxes by themselves.

SUMMARY OF THE INVENTION

Therefore, it is an object of the present invention to provide a paperboard box secured by screws and washers. A one-piece paperboard has 2 horizontal and 4 vertical creases, which partition the board into a top section and a base section, with each having a top/base and 4 sides (i.e., right, left, front and back). The back lateral is where these two sections connect. For both the top and the base sections, there are extended panels at the ends of the left and right sides. On the center of each panel there is a pre-pierced hole. When the box is folded into a cube, the panels are folded inwards, and on the front side and the back side corresponding to the holes of the panels there are also pierced holes. The pre-pierced holes are disposed on washers corresponding to the holes of the panels and the front sides. Through the holes, screws are used to secure the box. Finally, an in-box frame is fitted into the base of the box. This invention allows users to easily assemble boxes by themselves.

The above object, features and advantages of the present invention will become apparent from the following description when taken in conjunction with the accompanying drawings in which a preferred embodiment of the present invention is shown by way of illustrative example.

DESCRIPTION OF THE PREFERRED EMBODIMENT

Figure 1:
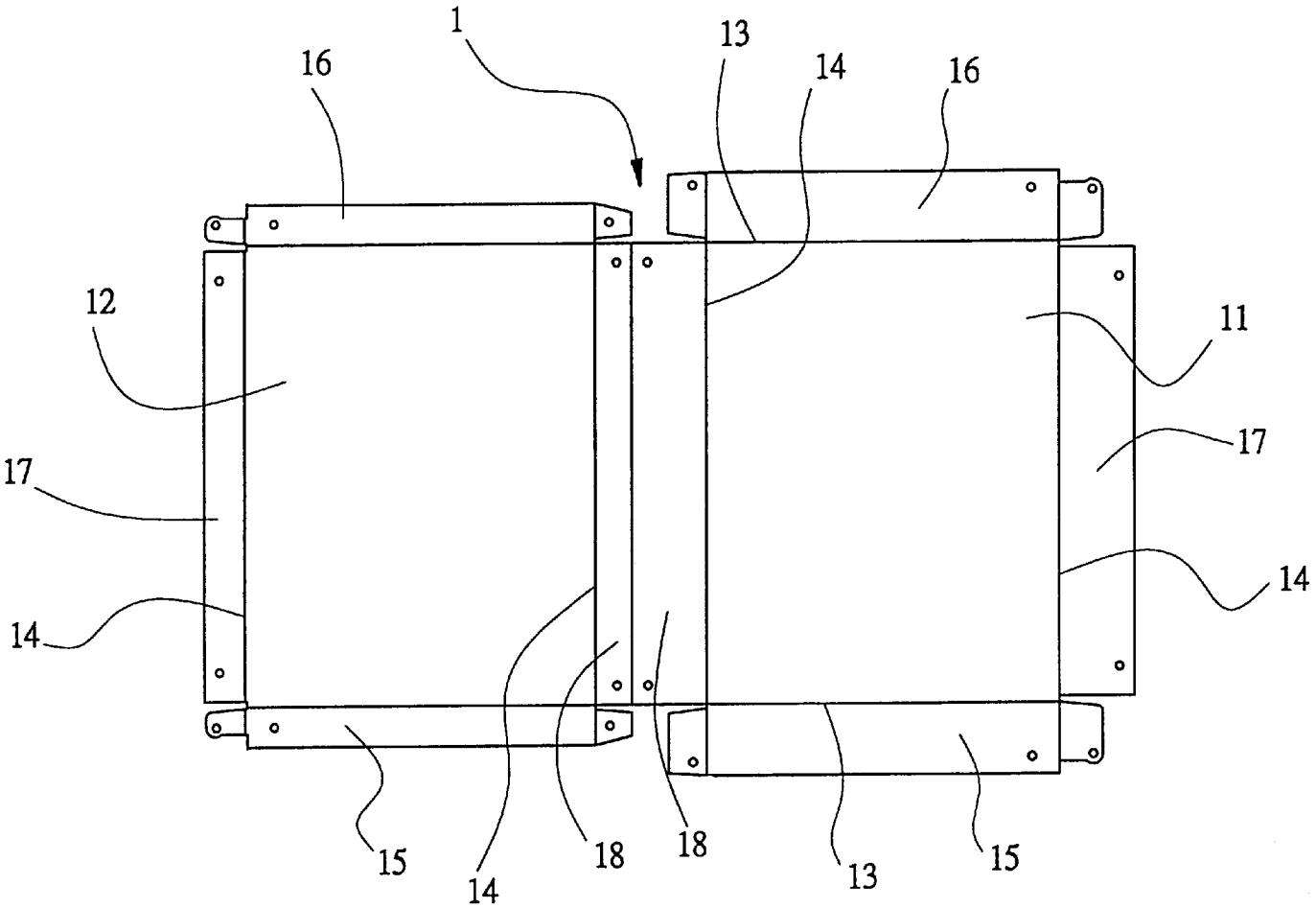
FIG. 1 is a planar schematic view of the present invention.
Figure 2:
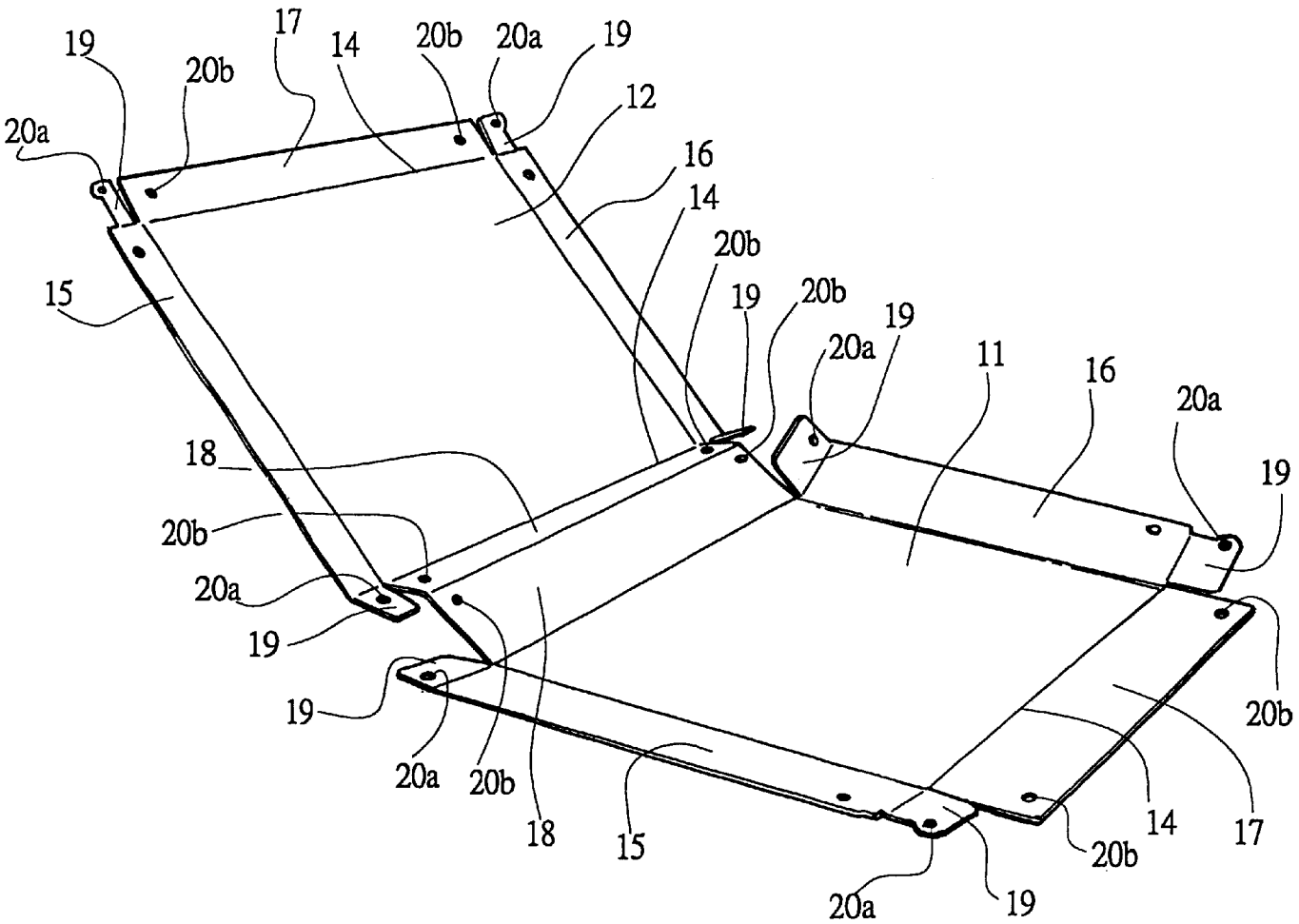
FIG. 2 is a schematic diagram of the present invention when being folded.
Figure 3:
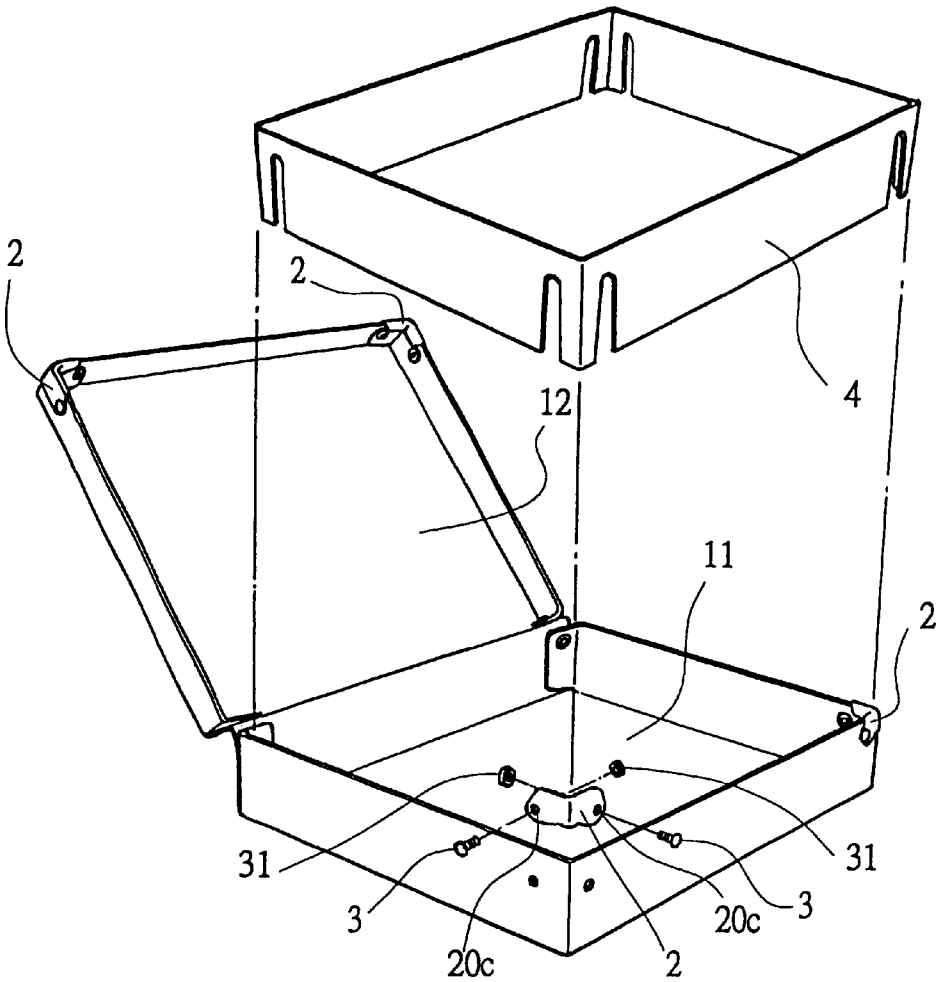
FIG. 3 is an assembling view of the present invention.
Figure 4:
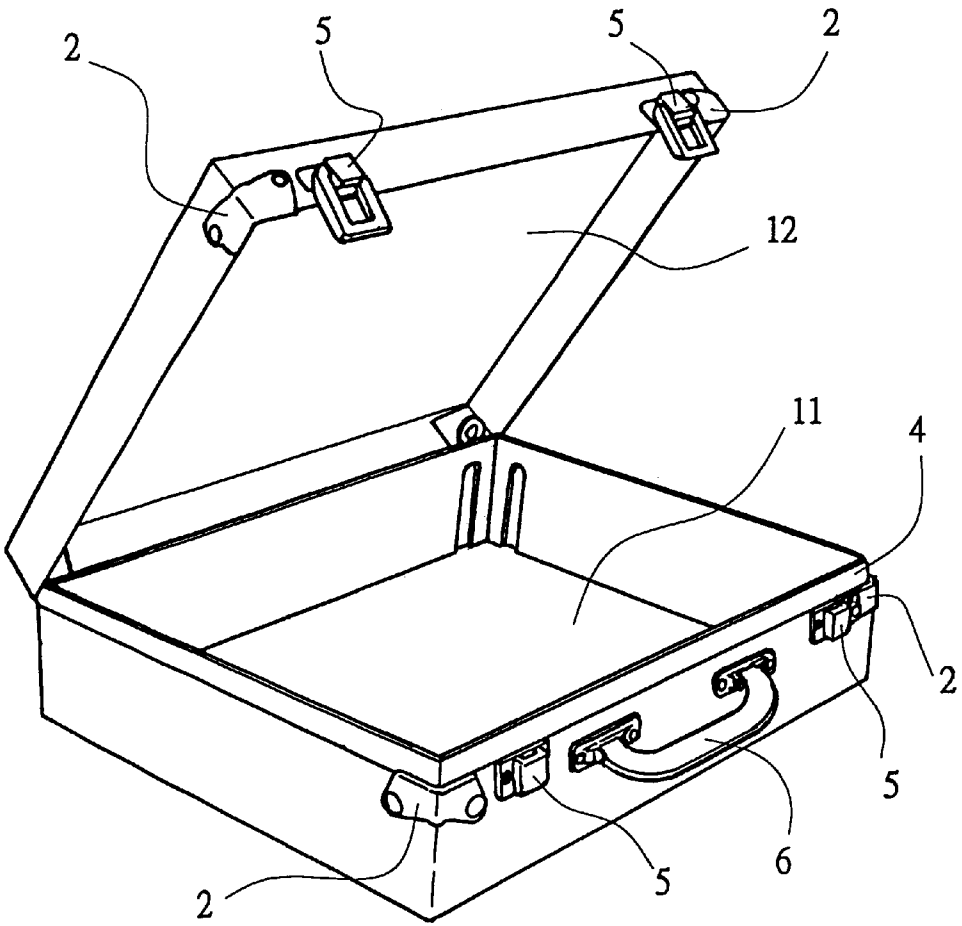
FIG. 4 is one embodiment of the present invention.

Referring to FIGS. 1, 2 and 3, a box of the present invention includes a paperboard 1, several curved washers 2, screws 3, and an in-box frame 4. The paperboard 1 is folded along two horizontal creases 13 and four vertical creases 14 to form a base 11 and a top 12, with each having left side 15, right side 16, front side 17, and back side 18. The back side 18 is where the top 12 and the base 11 connect with each other. The present invention is characterized in that, an extended panel 19 is disposed at each end of the left side 15 and right side 16 of both the top 12 and the base 11. A pre-pierced panel hole 20*a* is provided through each panel 19. A pre-pierced side hole 20*b* is also provided through each end of the front side 17 and the back side 18, each hole 20*b* corresponding in position to a hole 20*a*. When the paperboard 1 is folded into a three-dimensional rectangular form, the extended panels 19 are also bent inwards and overlap their adjacent sides, and the corresponding holes 20*a*, 20*b* will be in alignment. Refer to FIG.4, the four curved washers 2 with holes 20*c* formed therethrough are then arranged on the corners of the base 11 and the top 12, where the front side 17 meets the left side 15 and the right side 16. The holes 20*c* of the washers 2 correspond in position to pre-pierced holes 20*a* of panels 19 and pre-pierced holes 20*b* on two ends of the front sides 17. The washers 2 are then fastened with the left side 15, the right side 16, the front side 17, and the back side 18 by bolts 3 and nuts 3. At last, an in-box frame 4 is fitted within and adhered to the inner sides of the base 11. The design of the present invention enables users to assemble the box easily by themselves.

The present invention has the advantage of allowing users to easily set up a paperboard box with a few bolts 3 and nuts 31 locking four washers 2 with the lateral sides of the base 11 and the top 12 through the pre-pierced holes 20*a*, 20*b*, and 20*c*. Users only need simple tools such as a screwdriver to complete the assembling of the present invention and enjoy doing the box by themselves.

As shown in FIG. 4, another embodiment of the present invention can also be applied as a paper suitcase by installing a pair of buckles 5 at the front side 17 of both the base 11 and the top 12 and a handle 6 at the center of the front side 17 of the base 11. Suitcases made with paper, instead of leather, vinyl leather (synthesized leather), or plastics, are more suitable for surface printing, easier to produce, and friendly to the environment.

Although the present invention has been described with respect to a preferred embodiment, it is contemplated that a variety of modifications, variations and substitutions may be done without departing from the scope of the present invention that is intended to be defined by the appended claims.

What is claimed is:

1. A paperboard box comprising:

a) a paperboard including a base section and a top section having two horizontal and four vertical creases formed therein to define, for each of the base and top sections, a right side, a left side, a front side and a back side, the sides all being foldable about the creases to form a substantially rectangular box having a base and a top;

b) each of the left and right sides of the base and top sections having a pair of opposite ends, each opposite end forming an extended panel with a panel hole formed therethrough, each extended panel being foldable inwardly to overlap a folded adjacent side;

c) each of the front and back sides of the base and top sections having a pair of spaced holes formed therethrough adjacent opposite ends thereof;

d) each panel hole being aligned with a corresponding side hole when the sides are folded to form the base and top and the extended panels are folded inwardly to overlap their adjacent sides;

e) a curved washer disposed at each corner formed by the front and back sides and the left and right sides of the top and back sections, and a fastener extending through the aligned panel and side holes for securing the washer to the corner; and f) an in-box frame disposed within and adhered to the inner sides of the base.

* * * * *